US010215489B2

(12) United States Patent
Golubev

(10) Patent No.: US 10,215,489 B2
(45) Date of Patent: Feb. 26, 2019

(54) METHOD AND DEVICE FOR THE LOW-TEMPERATURE SEPARATION OF AIR AT VARIABLE ENERGY CONSUMPTION

(71) Applicant: LINDE AKTIENGESELLSCHAFT, Munich (DE)

(72) Inventor: Dimitri Golubev, Geretsried (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 4 days.

(21) Appl. No.: 15/322,740

(22) PCT Filed: Jun. 25, 2015

(86) PCT No.: PCT/EP2015/001285
§ 371 (c)(1),
(2) Date: Dec. 29, 2016

(87) PCT Pub. No.: WO2016/005031
PCT Pub. Date: Jan. 14, 2016

(65) Prior Publication Data

US 2017/0153058 A1 Jun. 1, 2017

(30) Foreign Application Priority Data

Jul. 5, 2014 (EP) ..... 14002307

(51) Int. Cl.
*F25J 3/04* (2006.01)

(52) U.S. Cl.
CPC ..... *F25J 3/04084* (2013.01); *F25J 3/042* (2013.01); *F25J 3/0403* (2013.01); *F25J 3/0409* (2013.01);
(Continued)

(58) Field of Classification Search
CPC .. F25J 3/04084; F25J 3/04175; F25J 3/04018; F25J 3/042; F25J 3/04345; F25J 3/04412; F25J 3/04721; F25J 3/0409; F25J 3/04054; F25J 3/04024; F25J 3/04296; F25J 3/04393; F25J 3/04678; F25J 2205/04; F25J 2245/50
See application file for complete search history.

(56) References Cited

U.S. PATENT DOCUMENTS 4,883,518 A * 11/1989 Skolaude ..... F25J 3/042 62/646
5,341,647 A 8/1994 Koeberle et al.
(Continued)

FOREIGN PATENT DOCUMENTS

DE 102010052545 A1 5/2012
EP 2520886 A1 11/2012
FR 2831249 A1 4/2003

*Primary Examiner* — Brian M King
(74) *Attorney, Agent, or Firm* — Millen White Zelano & Branigan, PC

(57) ABSTRACT

A method and a device used to variably obtain a compressed-gas product by means of the low-temperature separation of air in a distillation column system. In a first operating mode, a first amount of first compressed-gas product is obtained, and, in a second operating mode, a second, smaller amount is obtained. In the first operating mode, a first amount of high-pressure column nitrogen is compressed in a nitrogen compressor and in the second operating mode, a second, larger amount is compressed in the nitrogen compressor.

21 Claims, 4 Drawing Sheets

(52) U.S. Cl.
CPC ..... *F25J 3/04018* (2013.01); *F25J 3/04024* (2013.01); *F25J 3/04054* (2013.01); *F25J 3/04175* (2013.01); *F25J 3/04296* (2013.01); *F25J 3/04345* (2013.01); *F25J 3/04393* (2013.01); *F25J 3/04412* (2013.01); *F25J 3/04678* (2013.01); *F25J 3/04721* (2013.01); *F25J 3/04812* (2013.01); *F25J 2205/04* (2013.01); *F25J 2240/42* (2013.01); *F25J 2245/50* (2013.01)

(56) References Cited

U.S. PATENT DOCUMENTS

| | | | | |
|---|---|---|---|---|
| 5,400,600 | A | 3/1995 | Grenier | |
| 2013/0139548 | A1 | 6/2013 | Alekseev | |
| 2015/0241121 | A1* | 8/2015 | Cognard ..... | F25J 3/04812 62/644 |

* cited by examiner

METHOD AND DEVICE FOR THE LOW-TEMPERATURE SEPARATION OF AIR AT VARIABLE ENERGY CONSUMPTION

The invention relates to a method and a device for variably obtaining a pressurized-gas product by means of the low-temperature separation of air.

Methods and devices for the low-temperature separation of air are known for example from Hausen/Linde, Tieftemperaturtechnik [cryogenics], 2nd edition 1985, Chapter 4 (pages 281 to 337).

The distillation column system of such a plant may be formed as a two-column system (for example as a classic Linde double-column system), or else as a three- or multi-column system. In addition to the columns for nitrogen-oxygen separation, it may have further devices for obtaining high-purity products and/or other air components, in particular noble gases, for example argon production and/or krypton-xenon production.

In the process, during the course of an "internal compression" a product stream compressed in liquid form is evaporated against a heat transfer medium and finally obtained as a pressurized-gas product. This method is also referred to as internal compression. It serves for obtaining a gaseous pressurized product. In the case of a supercritical pressure, there is no phase transition in the actual sense; the product stream is then "pseudo-evaporated". The product stream may be for example an oxygen product from the low-pressure column of a two-column system or a nitrogen product from the high-pressure column of a two-column system or from the liquefaction space of a main condenser, in heat-exchanging connection by way of the high-pressure column and low-pressure column.

A heat transfer medium under high pressure is liquefied (or pseudo-liquefied if under supercritical pressure) against the (pseudo) evaporating product stream. The heat transfer medium is often formed by part of the air, in the present case by the "second partial stream" of the compressed feed air.

Internal compression processes are known, for example, from DE 830805, DE 901542 (=U.S. Pat. Nos. 2,712,738/2,784,572), DE 952908, DE 1103363 (=U.S. Pat. No. 3,083,544), DE 1112997 (=U.S. Pat. No. 3214925), DE 1124529, DE 1117616 (=U.S. Pat. No. 3,280,574), DE 1226616 (=U.S. Pat. No. 3,216,206), DE 1229561 (=U.S. Pat. No. 3,222,878), DE 1199293, DE 1187248 (=U.S. Pat. No. 3,371,496), DE 1235347, DE 1258882 (=U.S. Pat. No. 3,426,543), DE 1263037 (=U.S. Pat. No. 3,401,531), DE 1501722 (=U.S. Pat. No. 3,416,323), DE 1501723 (=U.S. Pat. No. 3,500,651), DE 253132 (=U.S. Pat. No. 4,279,631), DE: 2646690, EP 93448 B1 (=U.S. Pat. No. 4,555,256), EP 384483 B1 (=U.S. Pat. No. 5,036,672), EP 505812 B1 (=U.S. Pat. No. 5,263,328), EP 716280 B1 (=U.S. Pat. No. 5,644,934), EP 842385 B1 (=U.S. Pat. No. 5,953,937), EP 758733 B1 (=U.S. Pat. No. 5845517), EP 895045 B1 (=U.S. Pat. No. 6,038,885), DE 19803437 A1, EP 949471 B1 (U.S. Pat. No. 6,185,960 B1), EP 955509 A1(=U.S. Pat. No. 6,196,022 B1), EP 1031804 A1 (=U.S. Pat. No. 6,314,755), DE 19909744 A1, EP 1067345 A1 (=U.S. Pat. No. 6,336,345), EP 1074805 A1 (=U.S. Pat. No. 6,332,337), DE 19954593 A1, EP 1134525 A1 (=U.S. Pat. No. 6,477,860), DE 10013073 A1, EP 1139046 A1, EP 1146301 A1, EP 1150082 A1, EP 1213552 A1, DE 10115258 A1, EP 1284404 A1 (=U.S. 2003051504 A1), EP 1308680 A1 (=U.S. Pat. No. 6,612,129 B2), DE 10213212 A1, DE 10213211 A1, EP 1357342 A1 or DE 10238282 A1, DE 10302389 A1, DE 10334559 A1, DE 10334560 A1, DE 10332863 A1, EP 1544559 A1, EP 1585926 A1, DE 102005029274 A1, EP 1666824 A1, EP 1672301 A1, DE 102005028012 A1, WO 2007033838 A1, WO 2007104449 A1, EP 1845324 A1, DE 102006032731 A1, EP 1892490 A1, DE 102007014643 A1, A1, EP 2015012 A2, EP 2015013 A2, EP 2026024 A1, WO 2009095188 A2 or DE 102008016355 A1.

DE 102010052545 A1 shows a steady-state internal compression process in which an air stream is warmed up in the main heat exchanger and returned to the main air compressor.

The invention relates in particular to systems in which the entire feed air is compressed to a pressure well above the highest distillation pressure that prevails inside the columns of the distillation column system (this is normally the pressure of the high-pressure column). Such systems are also referred to as HAP processes (HAP—high air pressure). In this case, the "first pressure", that is to say the outlet pressure of the main air compressor (MAC), in which the entire air is compressed, is for example more than 4 bar, in particular 6 to 16 bar, above the highest distillation pressure. In absolute terms, the "first pressure" lies for example between 17 and 25 bar. In HAP processes, the main air compressor frequently represents the only or single machine driven by external energy for the compression of air. A "single machine" is understood here as meaning a single-stage or multi-stage compressor, all the stages of which are connected to the same drive, all of the stages being accommodated in the same housing or connected to the same transmission.

An alternative to such HAP processes is represented by so-called MAC-BAC processes, in which the air is compressed in the main air compressor to a relatively low overall air pressure, for example to the operating pressure of the high-pressure column (plus line losses). Part of the air from the main air compressor is compressed to a higher pressure in a booster air compressor (BAC) driven with external energy. This air part of the higher pressure (often known as the throttle stream) provides the majority of the heat necessary for the (pseudo) evaporation of the internally compressed product in the main heat exchanger. It is expanded downstream of the main air compressor in a throttle valve or in a liquid turbine (DLE=dense liquid expander) to the pressure required in the distillation column system.

Often, a fluctuating demand for internally compressed product makes it necessary to design an air separation plant for variable operation with variable pressurized-gas production. Conversely, it may be advisable to operate an air separation plant variably in spite of constant or substantially constant production, in that various operating modes that have varying levels of energy consumption are provided.

A specific example of such a constraint is the supply of internally compressed oxygen (GOXIV) and possibly other gaseous and/or liquid products in an ethylene oxide production plant. Here it is often the case that the oxygen demand is adapted to the state of the catalyst in the EO production; it may therefore be varied between 100% and about 70% during the lifetime of the catalyst (generally around 3 years). It is essential here that, during this time, the air separation plant is operated for about the same times with different amounts of GOXIV product (between 100% and about 70%). It is therefore important that the plant is operated efficiently not only in the design case of 100% GOXIV, but also in cases of underload. This requirement is made even more difficult by the production of other air separation products being independent of the GOXIV product; for example, the demand for one or more or all other air separation products may remain unchanged, while GOX production falls from 100% to for instance 70%. Such "other air separation products" and may be for example one or more or all of the following products:

internally compressed nitrogen product (GANIV)

other gaseous pressurized product, such as for example pressurized nitrogen removed in a gaseous form from the high-pressure column (HPGAN), which is possibly compressed further in a nitrogen compressor liquid product(s) such as liquid oxygen, liquid nitrogen and/or liquid argon.

With a conventional MAC-BAC process, this object can be achieved relatively well, since both compressors (MAC and BAC) are responsible for functionally separate tasks. In principle, the main air compressor only supplies the feed air for the separation; the booster air compressor supplies energy for the internal compression (GOXIV, GANIV) and for the liquid production. Both machines can generally be controlled relatively easily between 70% and 100%.

In the case of a HAP process, these two tasks (supply of separation air and of energy for the internal compression/liquid production) are achieved with a single compressor. This may lead to situations where certain operating cases are outside the range of performance characteristics of the compressor and cannot be implemented. The overall energy demand of an air separation plant is determined not only by the GOXIV product but to a great extent by liquid production or by other internally compressed products. However, the GOXIV product is often determinative for the amount of separation air. If the amount of GOXIV is reduced significantly, significantly less separation air is also introduced into the plant. Consequently, however, significantly less energy is also input into the system, which under some circumstances may no longer be sufficient for the desired production of other products (liquids, GANIV, etc.). In order to supply sufficient energy in spite of the significantly smaller amount of air, the compressor pressure must be raised significantly. This however is only feasible within limitations in the case of a HAP process, because the performance characteristics of the machine are limited and the design pressure for the "warm" part of the plant (precooling, adsorber etc.) must must not be exceeded.

The invention is based on the object of providing a method and a corresponding device that combine the advantages of HAP processes with a flexibility such as is known similarly in the case of MAC-BAC processes. "Flexibility" is understood here as being in particular that the system can be operated favorably in terms of energy not only for a specific amount of production of internally compressed product, but with an approximately constantly low specific energy consumption in a relatively wide load range. In particular, the production of other air separation products is intended to remain the same or at least change to a lesser extent than the amount of product of the internal compression product.

This object achieved by the features as described herein.

In the case of the invention, in the second operating mode of an oxygen-enriched process stream ("second process stream") is made to bypass the low-pressure column.

According to the invention, part of the nitrogen obtained in the high-pressure column is not introduced into the low-pressure column but is returned to a nitrogen product compressor, in that the multi-stage compressor is formed by a nitrogen product compressor, the first process stream is formed by a first gaseous nitrogen stream from the low-pressure column and the second process stream is formed by a first gaseous nitrogen stream from the high-pressure column.

If, in the process, for example owing to large amounts of nitrogen product, a low-pressure GAN compressor is provided as a nitrogen product compressor (specifically in the case of relatively high levels of production of internally compressed GAN), said low-pressure GAN compressor can be relieved of load through temporary feeding of pressurized GAN from the high-pressure column. By contrast to the design situation, in the case of low GOXIV production, considerably more air is introduced into the rectification system and extracted as pressurized GAN from the pressure column than is required for the oxygen production. After warming in the heat exchanger, said pressurized GAN is fed at a suitable location (for example downstream of the second or third compressor stage) at the nitrogen product compressor. In this way, the fraction of the low-pressure GAN (the amount of gas to be compressed from approximately atmospheric pressure to approximately 5 bar) can be correspondingly reduced. Thus, for example (by contrast to the design situation with 100% GOXIV) in the operating situation with approximately 75% GOXIV, full liquid production and 100% HPGAN product amount, approximately 70-75% low-pressure GAN and approximately 25-30% pressurized GAN from the pressure column are compressed. In this way, the energy absorbed with the excess amount of air at the main air compressor is partially recovered.

It is basically possible for the second process stream to also be mixed with the first process stream at the inlet of a nitrogen product compressor. In many cases however, it is favorable if the mixing of the second process stream with the first process stream is carried out at an intermediate stage of the multi-stage nitrogen product compressor.

In addition, in the second operating mode, an oxygen gas stream may be removed from the lower region of the low-pressure column and mixed with a nitrogen-enriched stream from the upper region of the low-pressure column and the mixture warmed up in the main heat exchanger.

Furthermore, in a specific embodiment of the invention, a second air turbine may be used, a third partial stream of the feed air compressed in the main air compressor being cooled down to an intermediate temperature in a main heat exchanger and expanded in the second air turbine in such a way that work is performed and at least a first part of the work-performing expanded third partial stream being introduced into the distillation column system.

Furthermore, the second partial stream of the feed air compressed in the main air compressor may be cooled down to an intermediate temperature in the main heat exchanger, recompressed to a third pressure, which is higher than the first pressure, in a second booster air compressor, which is operated as a cold compressor and is driven by the second turbine, cooled down in the main heat exchanger, (pseudo) liquefied and subsequently expanded and introduced into the distillation column system. In this way, the pressure of the second partial stream can be increased further without expending external energy. A correspondingly higher internal compressing pressure can be achieved.

In addition, a fourth partial stream of the air compressed in the main air compressor can be cooled down under the first pressure in the main heat exchanger and subsequently expanded and introduced into the distillation column system. The heat exchange process in the main heat exchanger is further optimized by such a second throttle stream.

In the case of another embodiment, with the a second turbine, it is favorable if the third partial stream is expanded in the second air turbine to a pressure that is at least I bar higher than the operating pressure of the high-pressure column, and the work-performing expanded third partial stream is cooled down further in the main heat exchanger and subsequently expanded and introduced into the distillation column system. The heat exchange process in the main heat exchanger is further optimized by such a third throttle stream.

In the case of the method according to the invention, in particular the transition from the first operating mode to the second operating mode, the total amount of air compressed in the main air compressor is not reduced at all or is reduced to a lesser extent than the amount of pressurized oxygen product, in that in the first operating mode, a first amount of feed air is compressed in the main air compressor and in the second operating mode, a second amount of feed air is compressed in the main air compressor, the ratio of the second amount of feed air to the first amount of feed air being greater, in particular by at least 3%, in particular greater by more than 5%, than the ratio between the second amount of first pressurized gas product and the first amount of first pressurized gas product.

In operating cases with lower GOXIV production, the amount of feed air into the cold box is "artificially" raised, that is to say more air is introduced into the low-temperature part of the plant than is necessary for obtaining the pressurized oxygen products specified for this operating case. If the feed air is operated in "surplus", the pressure at the compressor outlet can be reduced, since the supply of energy for the (pseudo) evaporation of the GOXIV product is then performed not with the pressure of the air but with the amount of air. It is important in this respect that the air is not just simply operated in excess (compressed in the main air compressor, cooled down in the heat exchanger, expanded in the turbine to the pressure of the high-pressure column, warmed up again in the heat exchanger and finally throttled to atmospheric pressure), but that, with the features described further above, other advantages are also achieved.

By this measure, sufficient air for the obtainment of other products continues to be available. As an example, cold can be produced sufficiently to supply a constant amount of liquid products.

Preferably, the first partial stream of the feed air compressed in the main air compressor is recompressed upstream of its introduction into the main heat exchanger in a first booster air compressor, which is operated in the warm state and in particular is driven by the first turbine. As a result, the inlet pressure of the first turbine is significantly higher than the first pressure to which the entire air is compressed. By contrast, the air for the second turbine is for example not recompressed, that is to say its inlet pressure lies at the lower level of the first pressure.

The invention also relates to a device as futher described herein.

The "means for switching over between a first operating mode and a second operating mode" are complex closed-loop and open-loop control devices, which together make at least partially automatic switching over between the two operating modes possible, for example by a correspondingly programmed process control system.

The invention and further details of the invention are explained more specifically below on the basis of exemplary embodiments that are schematically represented in the drawings.

Figure 1:
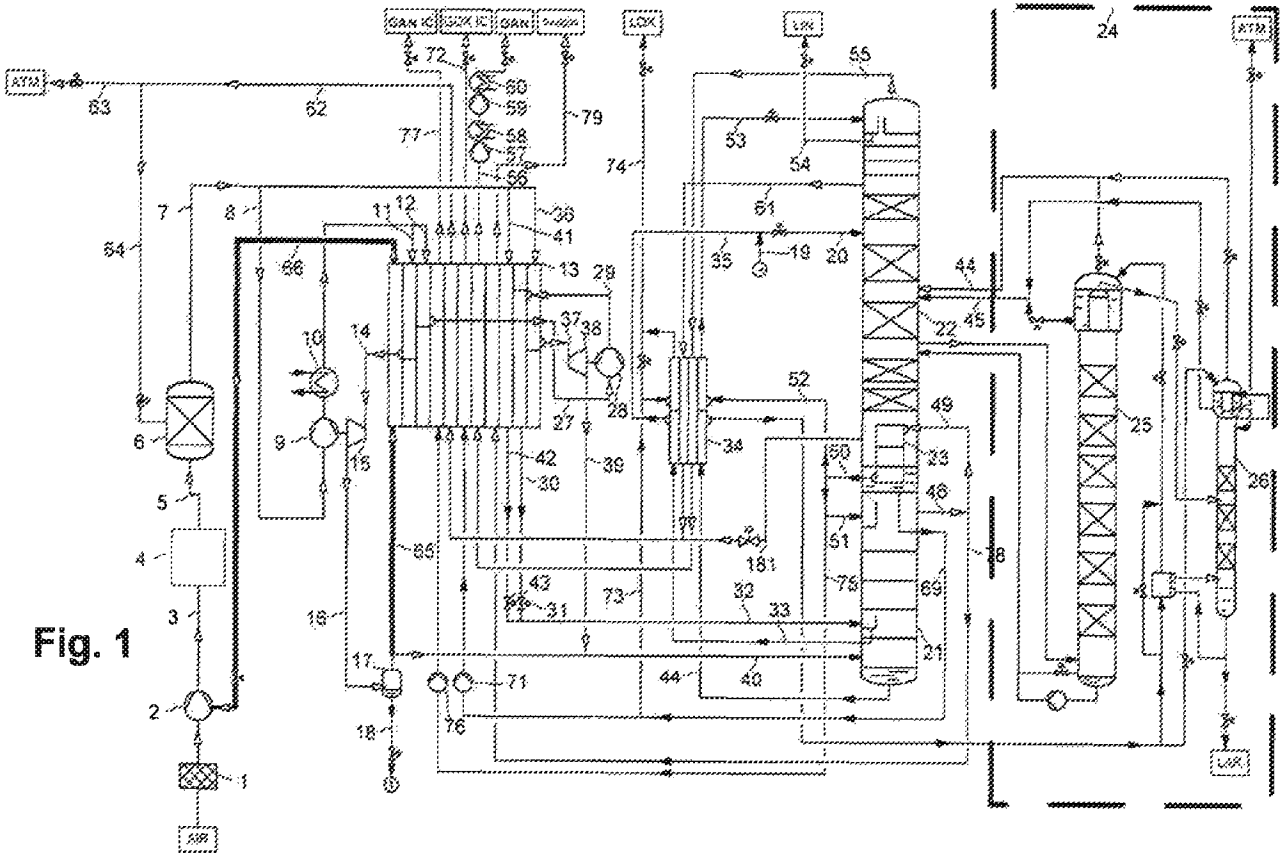
FIG. 1 shows an exemplary embodiment for a method with the return of turbine air to the main air compressor, which is not claimed here.

On the basis of FIG. 1, first the first operating mode of an embodiment of a method which is not claimed here is. Atmospheric air (AIR) is sucked in by a main air compressor 2 by way of a filter 1. The main air compressor has in the example five stages and compresses the entire air stream to a "first pressure" of for example 22 bar. The entire air stream 3 is cooled downstream of the main air compressor 2 under the first pressure in a pre-cooler 4. The pre-cooled entire air stream 5 is purified in a purifying device 6, which is formed in particular by a pair of switchable molecular sieve adsorbers. A first part 8 of the purified entire air stream 7 is recompressed in a booster air compressor 9, operated in a warm state and having an aftercooler 10, to a second pressure, for example 28 bar, and subsequently divided into a "first partial stream" 11 (first turbine air stream) and a "second partial stream" 12 (first throttle stream).

The first partial stream 11 is cooled down to a first intermediate temperature in the main heat exchanger 13. The cooled-down first partial stream 14 is expanded in such a way that work is performed from the second pressure to approximately 5.5 bar in a first air turbine 15. The first air turbine 15 drives the warm booster air compressor 9. The work-performing expanded first partial stream 16 is introduced into a separator (phase separator) 17. The liquid component 18 is introduced via the lines 19 and 20 into the low-pressure column 22 of the distillation column system.

The distillation column system comprises a high-pressure column 21, the low-pressure column 22 and a main condenser 23 and also a customary argon production 24 with a crude argon column 25 and a pure argon column 26. The main condenser 23 is formed as a condenser-evaporator, in the specific example as a cascade evaporator. The operating pressure at the top of the high-pressure column is in the example 5.3 bar, that at the top of the low-pressure column 1.35 bar.

The second partial stream 12 of the feed air is cooled down in the main heat exchanger 13 to a second intermediate temperature, which is higher than the first intermediate temperature, fed by way of line 27 to a cold compressor 28 and recompressed there to a "third pressure" of about 40 bar. At a third intermediate temperature, which is higher than the second intermediate temperature, the recompressed second partial stream 29 is introduced again into the main heat exchanger 13 and cooled down there up to the cold end. The cold second partial stream 30 is expanded in a throttle valve 31 to approximately the operating pressure of the high-pressure column and fed by way of line 32 to the high-pressure column 21. Part 33 is removed again, cooled down in a counter-current subcooler 34 and fed via the lines 35 and 20 into the low-pressure column 22.

A "third partial stream" 36 of the feed air is introduced under the first pressure into the main heat exchanger 13 and cooled down there to a fourth intermediate temperature, which in the example is somewhat lower than the first intermediate temperature. The cooled-down third partial stream 37 is expanded in such a way that work is performed from the first pressure to approximately the pressure of the high-pressure column in a second air turbine 37. The second air turbine 38 drives the cold compressor 28. The work-performing expanded third partial stream 39 is fed by way of line 40 to the high-pressure column 21 at the bottom.

A "fourth partial stream" 41 (second throttle stream) flows through the main heat exchanger 13 from the warm end to the cold end under the first pressure. The cold fourth partial stream 42 is expanded in a throttle valve 43 to approximately the operating pressure of the high-pressure column and fed by way of line 32 to the high-pressure column 21.

The oxygen-enriched bottom liquid of the high-pressure column 21 is cooled down in the counter-current subcooler 34 and introduced by way of line 45 into the optional argon production 24. Steam 46 thereby produced and remaining liquid 47 are fed into the low-pressure column 22.

A first part 49 of the top nitrogen 48 of the high-pressure column 21 is liquefied completely or substantially completely in the liquefaction space of the main condenser 23 against liquid nitrogen from the bottom of the low-pressure column that is evaporating in the evaporation space. A first part 51 of the liquid nitrogen 51 thereby produced is passed as reflux to the high-pressure column 21. A second part 52 is cooled down in the counter-current subcooler 34 and fed by way of line 53 into the low-pressure column 22. At least part of the liquid low-pressure nitrogen 53 serves as reflux in the low-pressure column 21; another part 54 may be obtained as liquid nitrogen product (LIN).

Gaseous low-pressure nitrogen 55 is drawn off from the top of the low-pressure column 22, in the counter-current subcooler 34 and warmed up in the main heat exchanger 13. The warm low-pressure nitrogen 56 is compressed in a nitrogen product compressor (57, 59), which consists of two sections and has intermediate and aftercooling (58, 60), to the desired product pressure, which in the example is 12 bar. The first section 57 of the nitrogen product compressor consists for example of two or three stages with associated aftercoolers; the second section 59 has at least one stage and is preferably likewise intermediately cooled and aftercooled.

From an intermediate point low-pressure column 22, gaseous impure nitrogen 55 is drawn off, in the counter-current subcooler 34 and warmed up in the main heat exchanger 13. The warm impure nitrogen 62 may be blown off (63) into the atmosphere (ATM) and/or used as regenerating gas 64 for the purifying device 6.

The lines 67 and 68 (so-called argon transfer) connect the low-pressure column 21 to the crude argon column 25 of the argon production 24.

A first part 70 of the liquid oxygen 69 is drawn off from the bottom of the low-pressure column 21 as the "first product stream", brought to a "first product pressure" of for example 37 bar in an oxygen pump 71 and evaporated under the first product pressure in the main heat exchanger 13 and finally obtained by way of line 72 as the "first pressurized gas product" (GOX IC—internally compressed gaseous oxygen).

A second part 73 of the liquid oxygen 69 from the bottom of the low-pressure column 21 is possibly cooled down in the counter-current subcooler 34 and obtained by way of line 74 as liquid oxygen product (LOX).

In the example, a third part 75 of the liquid nitrogen 50 from the high-pressure column 21 or the main condenser 23 is also subjected to an internal compression, in that it is brought to a second product pressure of for example 37 bar in a nitrogen pump 76, is pseudo-evaporated under the second product pressure in the main heat exchanger 13 and finally obtained by way of line 77 as internally compressed gaseous nitrogen pressurized product (GAN IC).

A second part 78 of the gaseous top nitrogen 48 of the high-pressure column 21 is warmed up in the main heat exchanger and either obtained by way of line 79 as gaseous medium-pressure product or—as represented—used as sealgas for one or more of the process pumps represented.

If the "first operating mode" is used to refer to operation with maximum oxygen production (100% according to the design), in this operating mode the lines 65/66 shown as bold remain out of operation.

A lower oxygen production (for example 75%) may then be regarded as the "second operating mode". Here, part of the gaseous component 17 of the work-performing expanded first partial stream 16 is returned as the "second process stream" by way of the lines 65, 66 through the main heat exchanger to an intermediate stage of the main air compressor 2. In the example, the return stream is mixed with the feed air between the second and third stages or between the third and fourth stages of the main air compressor. (This feed air here represents the "first process stream".) As a result, the amount of air through the turbine 15 can be kept relatively high and an amount of nitrogen and liquid products that is unchanged—or at least reduced to a lesser extent—can be obtained.

Equally well, a 95% operating level could be regarded as the "first operating mode". A "second operating mode" is then achieved for example with an oxygen production of 90% of the design value.

The following table specifies numerical values, given by way of example, of two different operating modes of the plant from FIG. 1:

| Amount of GOX-IC 72 | Amount of air through filter 1 | Return amount 65/66* |
|---|---|---|
| 100% | 100% | 0% |
| 76% | 83% | 4.2% |

The return amount in the table relates to the amount of air at the time through filter 1. Unless otherwise indicated, all of the percentages given here and in the rest of the text refer to molar amounts.

Figure 2:
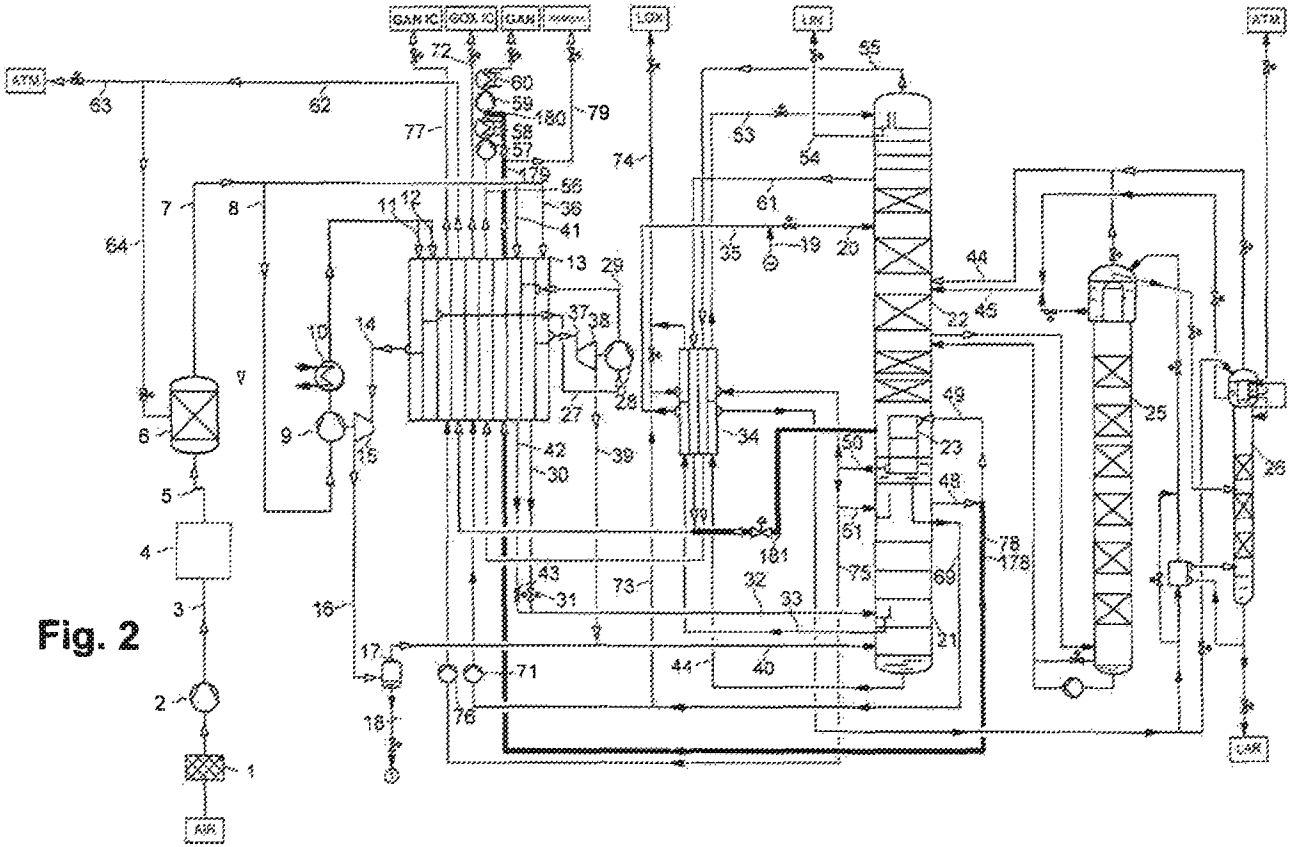
FIG. 2 shows an exemplary of the invention with the introduction of gaseous nitrogen from the high-pressure column into a nitrogen product compressor.

In FIG. 2, an embodiment of the invention is represented. It differs from FIG. 1 by the features described below; otherwise the description of FIG. 1 also applies to FIG. 2.

The return line 65, 66 for air is absent here. Instead, in the second operating mode, an additional part 180 of the gaseous top nitrogen 48 from the top of the high-pressure column is passed in addition to the amount of sealgas 79 by way of the lines 178, 179 as the "second process stream" 180 and finally, between the two sections 57, 59 of the nitrogen product compressor, is mixed with the nitrogen 56 from the low-pressure column, which in the variant forms the "first process stream".

The corresponding amount of nitrogen 180 from the high-pressure column is not condensed in the main condenser 23 and not introduced into the low-pressure column. As a result, it does not take part in the rectification in the low-pressure column (neither indirectly by way of the evaporation of the bottom oxygen, nor directly by use as a return liquid) and thereby makes the reduction of oxygen production possible. At the same time, the same amount of air (or only insubstantially less) is available for the production of cold and the production of nitrogen.

In the first operating mode, a smaller amount of the second process stream 180 is passed to the intermediate point of the nitrogen product compressor or line 180 is closed completely.

The flexibility of the method can be increased further by the optional measure described below (which in principle can also be used in the method according to FIG. 1). Here, in the second operating mode, gaseous oxygen 181 is drawn off from the low-pressure column and mixed with the gaseous impure nitrogen 61 from the low-pressure column.

The mixing takes place in the example downstream of the counter-current subcooler 34. In the first operating mode, the line 181 is closed or less gas is passed by way of line 181.

The following table indicates numerical values, given by way of example, of two different operating modes of the plant from FIG. 2:

| Amount of GOX-IC 72 | Amount of air through main air compressor 2 | Amount of nitrogen through line 180 | Amount of oxygen through line 181 |
|---|---|---|---|
| 100% | 100% | 0% | 0% |
| 76% | 83% | 5% | 0% |

The amount of nitrogen through line 180 relates to the amount of air through filter 1 in the design case.

Figure 3:
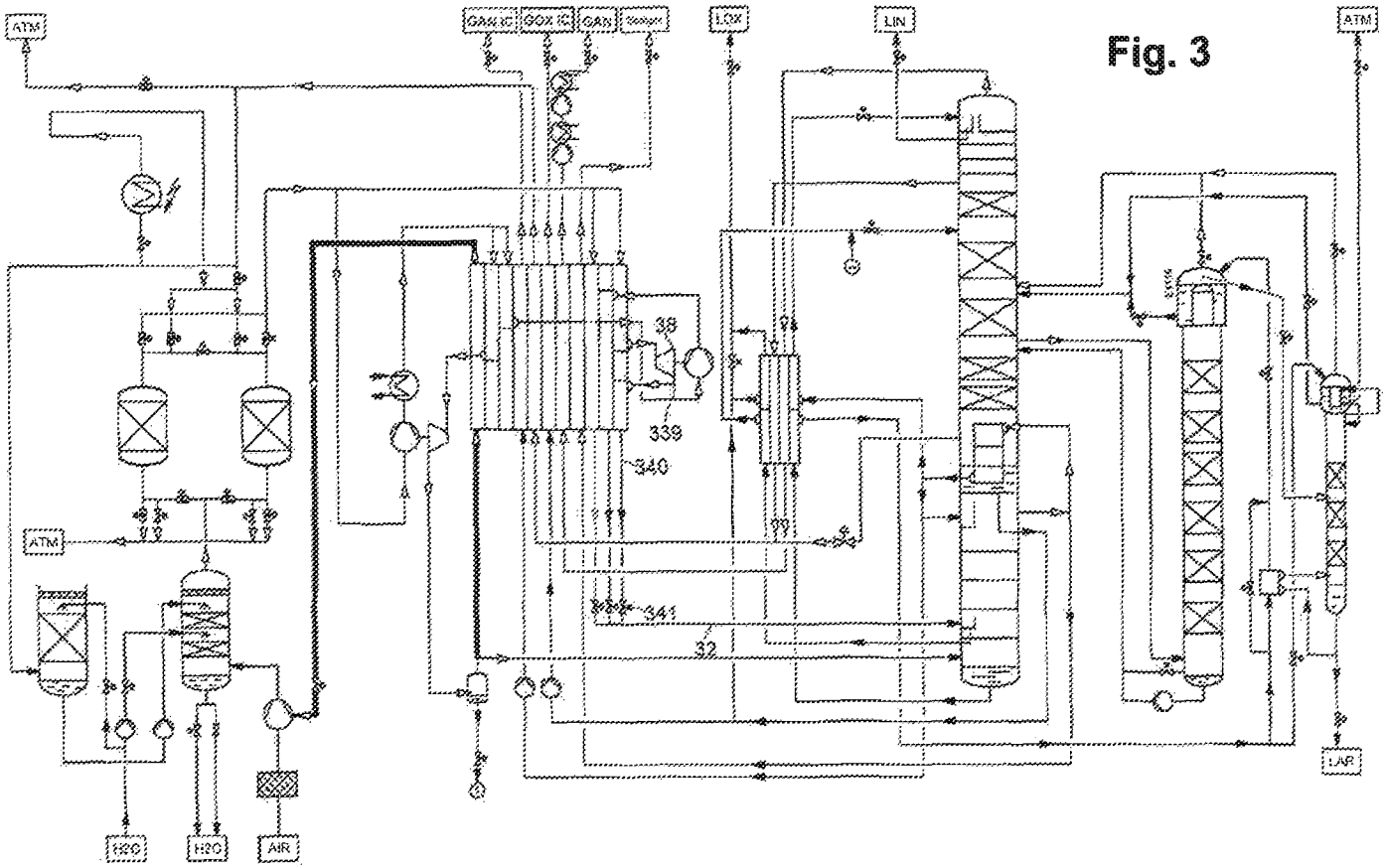
FIGS. 3 and 4 show modifications of FIG. 1 with a third throttle stream.

FIG. 3 differs from FIG. 1 by a third throttle stream. For this, the second turbine 38 is operated with a relatively great outlet pressure and a relatively high outlet temperature. The work-performing expanded turbine stream 339 then has a pressure that is at least 1 bar, in particular 4 to 11 bar, above the operating pressure of the high-pressure column, and a temperature that is at least 10 K, in particular 20 to 60 K, above the inlet temperature of the low-pressure nitrogen streams 55, 61 at the cold end of the main heat exchanger. This stream is then cooled down further in the cold part of the main heat exchanger. The further cooled-down third partial stream 340 is expanded as the third throttle stream in a throttle valve 341 to approximately the pressure of the high-pressure column and is introduced into the high-pressure column by way of line 32. As a result, the heat exchanging process in the main heat exchanger is further optimized.

Figure 4:
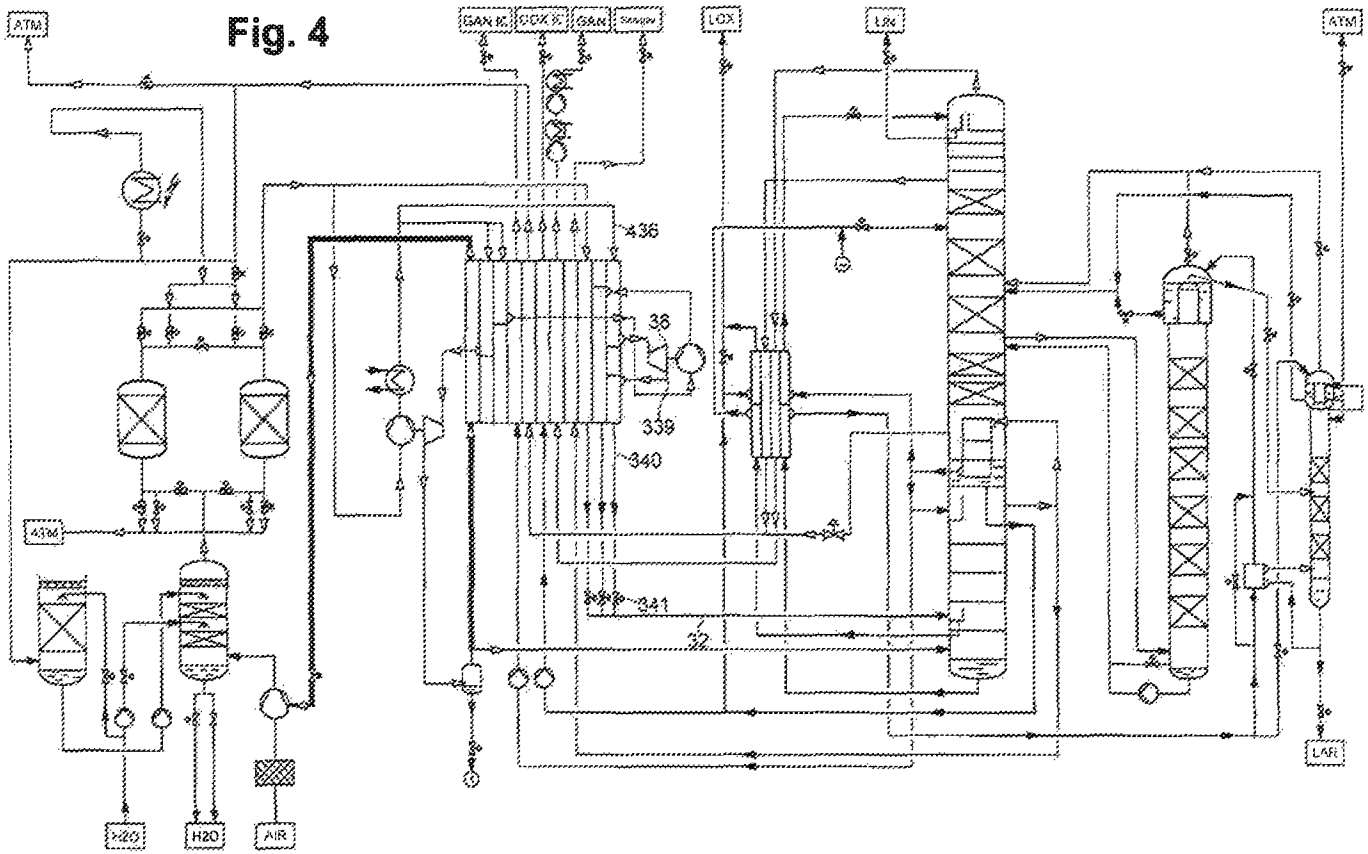

In FIG. 4, as a departure from FIG. 3, the third partial stream 436 is introduced into the second turbine 38 not under the first pressure, but under the higher second pressure.

The additional measures of FIGS. 3 and 4 can be used not only in the case of the variant of the invention according to FIG. 1 but also in the case of the invention.

The invention claimed is:

1. A method for variably obtaining a pressurized-gas by means of low-temperature separation of air in a distillation column system comprising a high-pressure column and a low-pressure column, said method comprising:

compressing the entire feed air in a main air compressor to a first pressure, which is at least 4 bar higher than an operating pressure of the high-pressure column, cooling a first partial stream of the feed air compressed in the main air compressor to a first intermediate temperature in a main heat exchanger, and work expanding the first partial stream in a first air turbine to form an expanded first partial stream, introducing at least a first part of the expanded first partial stream into the distillation column system, further compressing a second partial stream of the feed air compressed in the main air compressor to a second pressure, which is higher than the first pressure, in a first booster air compressor driven by the first turbine, cooling the second partial stream in the main heat exchanger, and subsequently expanding the second partial stream and introducing the expanded second partial stream into the distillation column system, removing a first product stream in liquid form from the distillation column system and increasing the pressure of the first product stream to a first product pressure, evaporating or pseudo-evaporating and warming the first product stream in the main heat exchanger, obtaining warmed first product stream as a first pressurized-gas product, compressing a first process stream, containing at least 78 mol % of nitrogen, in a multi-stage compressor from an inlet pressure to a final pressure, wherein the multi-stage compressor is a nitrogen product compressor and wherein the first process stream is a first gaseous nitrogen stream from the low-pressure column, said method further comprising in said first operating mode, obtaining a first amount of said first pressurized-gas product, in said second operating mode, obtaining a second amount of said first pressurized-gas product, which is smaller than the first amount first pressurized-gas product, in the first operating mode, obtaining a second process stream which is a first gaseous stream from the high-pressure column and contains at least 78 mol % of nitrogen, and wherein no amount or a first amount of the second process stream is mixed with the first process stream downstream of a first stage of the multi-stage compressor and, with the first process stream, is compressed in the multi-stage compressor, and in the second operating mode, a second amount of the second process stream is compressed in the multi-stage compressor, wherein said second amount of the second process stream is greater than the amount of the second process stream compressed in the multi-stage compressor in said first operating mode.

2. The method as claimed in claim 1, wherein in the first operating mode, said first amount of the second process stream is mixed with the first process stream.

3. The method as claimed in claim 1, further comprising, in the second operating mode, removing an oxygen gas stream from a lower region of the low-pressure column, mixing the oxygen gas stream with a nitrogen-enriched stream from an upper region of the low-pressure column to form a mixture, and warming the mixture in the main heat exchanger.

4. The method as claimed in claim 1, wherein before said cooling and expanding of the second partial stream, the second partial stream is cooled in the main heat exchanger to a second intermediate temperature in the main heat exchanger, the second partial stream is then further compressed to a third pressure, which is higher than the first pressure, in a second booster air compressor, which is operated as a cold compressor and is driven by the second turbine, and then the second partial stream is introduced into the main heat exchanger at a third intermediate temperature and cooled in the main heat exchanger, expanded, and introduced into the distillation column system.

5. The method as claimed in claim 4, further comprising cooling a third partial stream of the feed air compressed in the main air compressor to a fourth intermediate temperature in the main heat exchanger and work-expanding the third partial stream in a second air turbine to form an expanded third partial stream, and introducing at least part of the expanded third partial stream into the distillation column system.

6. The method as claimed in claim 5, wherein a fourth partial stream of the feed air compressed in the main air compressor is cooled under the first pressure in the main heat exchanger, expanded and introduced into the distillation column system.

7. The method as claimed in claim 6, wherein the third partial stream is work-expanded in the second air turbine to a pressure that is at least one bar higher than an operating pressure of the high-pressure column, and before the at least part of the third partial stream is introduced into the distillation column system, the expanded third partial stream is further cooled in the main heat exchanger and subsequently expanded.

8. The method as claimed in claim 1, wherein in the first operating mode, a first amount of feed air is compressed in the main air compressor and in the second operating mode, a second amount of feed air is compressed in the main air compressor, and wherein the ratio of the second amount of feed air to the first amount of feed air is, greater than the ratio between the second amount of first pressurized-gas product and the first amount of first pressurized-gas product.

9. The method as claimed in claim 1, wherein the first partial stream of the feed air compressed in the main air compressor is further compressed, upstream of the main heat exchanger, in said first booster air compressor.

10. A device for variably obtaining a pressurized-gas by low-temperature separation of air, said device comprising:

a distillation column system having a high-pressure column and a low-pressure column, a main air compressor for compressing the entire feed air to a first pressure, which is at least 4 bar higher than an operating pressure of the high-pressure column, a main heat exchanger, means within the main heat exchanger for cooling down a first partial stream of the feed air compressed in the main air compressor to an intermediate temperature, a first air turbine for work-expanding the first partial stream removed from the main heat exchanger, means for introducing the expanded first partial stream into the distillation column system, a first booster air compressor for further compressing a second partial stream of the feed air compressed in the main air compressor to a second pressure, which is higher than the first pressure, wherein the first booster air compressor is driven by the first turbine, is recompressed, means in the main heat exchanger for cooling the further compressed second partial stream, means for expanding the second partial stream removed from the main heat exchanger, and introducing the second partial stream into the distillation column system, means for removing a first product stream in liquid form from the distillation column system, and means for increasing the pressure of the first product stream to a first product pressure, means in the main heat exchanger for evaporating or pseudo-evaporating and warming the first product stream under the first product pressure, means for obtaining the first product stream as a first pressurized-gas product, a multi-stage compressor for compressing a first process stream, containing at least 78 mol % of nitrogen, from an inlet pressure to a final pressure, wherein the multi-stage compressor is a nitrogen product compressor and wherein the first process stream is a first gaseous nitrogen stream from the low-pressure column, means for mixing a second process stream, containing at least 78 mol % of nitrogen, with the first process stream downstream of the first stage of the multi-stage compressor, wherein the second process stream is a first gaseous nitrogen stream from the high-pressure column, means for switching over between a first operating mode and a second operating mode, wherein in the first operating mode, a first amount of first pressurized-gas product is obtained, wherein in a second operating mode, a second amount of first pressurized-gas product, which is smaller than the first amount, is obtained and the means for switching over between the first operating mode and the second operating mode permitting in the first operating mode, compressing no amount or a first amount of the second process stream in the multi-stage compressor from an inlet pressure to a final pressure and in the second operating mode, compressing a second amount of the second process stream, which is greater than the amount of the second process stream compressed in the first operating mode, in the multi-stage compressor.

11. The method according to claim 5, wherein the inlet pressure of the second air turbine is equal to the first pressure.

12. The method according to claim 5, wherein said third partial stream of the feed air is introduced into the main heat exchanger at the first pressure.

13. The method according to claim 5, wherein a fourth partial stream of the feed air compressed in the main air compressor is cooled under the first pressure in the main heat exchanger, expanded and introduced into the distillation column system.

14. The method according to claim 1, wherein in the first operating mode, a first amount of feed air is compressed in the main air compressor, in the second operating mode, a second amount of feed air is compressed in the main air compressor, and wherein the ratio of the second amount of feed air to the first amount of feed air is at least 3% greater than the ratio between the second amount of first pressurized-gas product and the first amount of first pressurized-gas product.

15. The method according to in claim 14, wherein the ratio of the second amount of feed air to the first amount of feed air is more than 5% greater than the ratio between the second amount of first pressurized-gas product and the first amount of first pressurized-gas product.

16. The method according to in claim 1, wherein the first pressure is 6 to 16 bar, higher than said operating pressure of the high-pressure column.

17. The method according to claim 1, wherein the first pressure is between 17 and 25 bar.

18. The method according to claim 4, wherein the second intermediate temperature is higher than the first intermediate temperature.

19. The method according to claim 4, wherein the third intermediate temperature is higher than the second intermediate temperature.

20. The method according to claim 18, wherein the third intermediate temperature is higher than the second intermediate temperature.

21. The method according to claim 5, wherein the fourth intermediate temperature is lower than the first intermediate temperature.

* * * * *